United States Patent [19]

Li

[11] Patent Number: 4,459,781

[45] Date of Patent: Jul. 17, 1984

[54] GRINDING AND POLISHING APPARATUS

[76] Inventor: Chou H. Li, 379 Elm Dr., Roslyn, N.Y. 11576

[21] Appl. No.: 248,856

[22] Filed: Mar. 30, 1981

[51] Int. Cl.[3] ..... B24B 37/04

[52] U.S. Cl. ..... 51/123 R; 51/209 DL; 51/263; 51/292

[58] Field of Search ..... 51/209 R, 209 DL, 122, 51/123 R, 131.3, 131.4, 263, 264, 292, 317, 318, 326, 327

[56] References Cited

U.S. PATENT DOCUMENTS

| | | | |
|---|---|---|---|
| 406,954 | 7/1889 | Potter | 51/209 R |
| 432,212 | 7/1890 | Nelson | 51/209 R X |
| 1,114,160 | 10/1914 | Macbeth | 51/263 X |
| 1,182,137 | 5/1916 | Boyle | 51/264 |
| 1,311,517 | 7/1919 | Hitchcock | 51/292 X |
| 1,763,820 | 6/1930 | Rodemeyer | 51/209 R X |
| 2,419,739 | 4/1947 | Spina | 51/131.4 |
| 2,450,742 | 10/1948 | Stevens | 51/123 R |
| 2,534,384 | 12/1950 | Spira | 51/229 |
| 3,299,579 | 1/1967 | Jacobson | 51/327 |
| 3,680,265 | 8/1972 | McClure | 51/131.4 |
| 3,971,165 | 7/1976 | Packard et al. | 51/131.4 |
| 4,048,763 | 9/1977 | Janssen | 51/292 |

*Primary Examiner*—Robert P. Olszewski

[57] ABSTRACT

An apparatus for grinding/polishing the surface of material samples comprises a horizontal circular wheel which has an upper surface and rotates about its central vertical axis of rotation. On the upper surface is provided mixed abrasive particles centrifugally separated to have the larger particles located near the wheel periphery while the smaller particles near the wheel center. A one-step grinding/polishing operation is thus achieved which is fast, economical, and reproducible. Methods for preparing the apparatus and for the improved grinding/polishing process are also disclosed.

12 Claims, 4 Drawing Figures

GRINDING AND POLISHING APPARATUS

BACKGROUND

1. Field

This invention relates to mechanical surface preparation (i.e., grinding and/or polishing) of material samples, and more particularly to improved apparatus and method for mechanically preparing material samples by means of abrasive particles.

2. Prior Art

Conventionally, the surface of material samples is mechanically prepared (i.e., ground and/or polished) by abrading the surface, in several or many operations, with a series of abrasive particles of decreasing sizes, until a final surface finish of the desired smoothness is achieved. In each operation, abrasive particles of a particular grit size (such as #2, #1, #0, #00, #000, 10-mesh, 100-mesh, 200-mesh, 320-mesh, and 400-mesh) and type (generally alumina or silicon carbide) are employed. These particles are either bonded, by vitrified, silicate, shellac, resinoid, rubber, or magnesite bonding, onto the grinding/polishing paper in the form of the usual sandpaper, or are fed in a water or oil stream onto the rotating wheel. Usually, only a ring of very narrow width on the paper or wheel is used to do the surface preparation.

In going from one surface preparation operation to the next with finer-sized abrasive particles, the material sample has to be carefully cleaned and inspected. It is advisable to rotate the sample 90 degrees to facilitate recognizing when the coarse scratches have been entirely replaced by the finer ones.

The wheel speed is important. Since the rate of cutting or abrasion depends on the linear velocity and not on the rpm, a higher rate of cutting is always obtained at the periphery than at the center; and likewise, the larger the wheel, the higher the rate of cutting. High speeds are not conducive to the best results and do not appreciably expediate the process. A speed of 600 to 700 rpm for a 9-inch wheel is satisfactory. With well constructed machines free from vertical vibration, higher speeds can be used safely.

Accordingly, an object of the present invention is to provide improved mechanical surface preparation apparatus and method;

A further object of the present invention is to provide simplified, mechanical surface preparation apparatus and method;

A broad object of the invention is to provide one-step, mechanical surface preparation method to make the process fast, efficient, low in cost, independent of the operator skill, and reproducible.

Another object of the invention is to provide new methods to make these novel mechanical surface preparation apparatus.

SUMMARY

To these ends, the present invention provides an apparatus for mechanically preparing the surface of material samples which comprises a horizontal circular wheel having an upper surface and rotating about its central vertical axis of rotation. The apparatus also has means for providing onto the upper surface mixed abrasive particles with the larger particles being provided at greater radial distances from the center of the wheel than the finer abrasive particles. This provision of the mixed but separated abrasive particles is, in one version of the invention, achieved by centrifugal forces simultaneously acting on all the mixed abrasive particles, to separate them into concentric rings of decreasing particle sizes toward the center of the wheel. While thus separated, the abrasive particles may be used directly to abrade the material sample, or may be further bonded (by the usual means mentioned previously) in their separated states to the wheel directly or to some paper disc placed on the wheel. Alternately, different-sized abrasive particles may be screen-printed onto the wheel directly or onto a backing paper placed on the wheel in the form of concentric rings. These rings may be very distinct or somewhat diffused relative to the particle sizes.

BRIEF DESCRIPTION

The invention and its further objects and features will be more clearly understood from the following detailed description, taken in conjunction with the drawing in which.

It will be understood that the specific embodiments described are merely illustrative of the general principles of the invention and that various modifications are possible without departing from the spirit and scope of the invention. That is, the invention is of general applicability for increasing the efficiency and reliability, but reducing the cost of the mechanical surface preparation process.

More particularly, it will be evident the invention may be employed to grind and/or polish rapidly the surface of material samples at low cost, with uniform results independently of the operator's skill and experience.

Still further, it will be apparent that materials other than those specifically described may be used to practice the invention.

DETAILED DESCRIPTION

Figure 1:
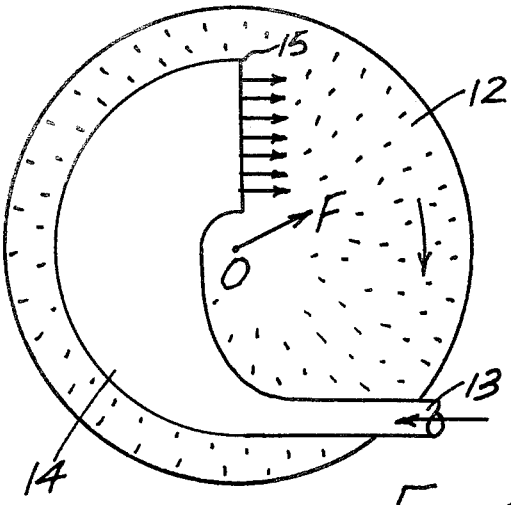
FIG. 1 shows an apparatus for centrifugally separating a lot of mixed abrasive particles for immediate use to abrade the material sample or for making the new sandpaper according to the invention.

With reference to FIG. 1, the mixed abrasive particles of, e.g., the usual alumina, silicon carbide, tungsten carbide, or diamond variety but with sizes varying by over (three) orders of magnitude from about 1 mm down to submicrons, may be carried by an air, oil, or water stream. These particles are fed either at the center O of a planar and flat or smooth (i.e., grooveless), upper grinding/polishing surface of a clockwise rotating, horizontal wheel 12, or at the entrance end 13 of a monotonically or continuously expanding and curved feed duct 14. With central feeding, the mixed abrasive particles, upon contacting the rotating wheel 12 rotating at 20 to 600 rpm, acquire the rotational velocities from the wheel 12, and are thus centrifugally separated. The larger and denser particles touch the rotating surface faster and more and, hence, achieve higher radial or centrifugal accelerations and velocities. Hence, for a given centrifuging time, the larger and denser abrasive particles are moved to the periphery of the wheel 12 while the smaller and/or lighter particles, contacting the same surface of the wheel 12 later and/or less and thus being less affected by the centrifuging action, stay relatively close to the center of the wheel 12. Abrasive particles of the same chemical composition, e.g., alumina, are, of course, equally dense (specific gravity 4.0) and will be separated only according to the particle sizes.

As shown in FIG. 1, with the duct feeding, the mixed but centrifugally separated abrasive particles are fed over a significant or even major portion of a selected radius of the wheel 12, or of a selected line extending from the center of the wheel at O to the periphery of the wheel 12. With the duct feeding, the mixed abrasive particles in a suitable suspension are also forced to move from linear paths at the narrow entrance end 13 and to change to continuously or monotonically expanding, paths in curved duct 14. The mixed abrasive particles are impelled by centrifugal forces and are thus separated, larger and denser particles being outmost while finer and less dense particles being closer to the center O of the wheel 12. That is, the larger and denser particles, being more affected by centrifugal forces, are fed to the horizontal wheel 12 at near the periphery thereof, while the finer and lighter particles are fed near the center O of the same wheel 12.

With duct feeding, the mixed abrasive particles are already separated inside the feed duct 14. Hence, the wheel 12 need only be rotated at a minimal speed (5 to 50 rpm), i.e., only sufficiently fast to allow the outcoming, separated abrasive particles to be gently deposited onto the wheel surface. If additional centrifugal separation action is needed on the wheel 12, the wheel may be rotated at a higher speed (e.g., 25 to 300 rpm). Note that with either the central or duct feeding, the larger abrasive particles merge continuously into the finer abrasive particles toward the center of the wheel 12. The separated abrasive particles are discharged onto an elongated discharge region on the upper surface of the wheel 12, near the exit end 15 of the feed duct 14. This discharge region is generally centered along a major or significant portion of a wheel radius, or of a straight or curved line, extending from the center of the wheel 12 to the periphery thereof. Both the central feeding and duct feeds practiced on the FIG. 1 apparatus provide concentric rings of abrasive particles of larger particle sizes continuously merging into those of finer sizes toward the center of the wheel.

The material sample to be ground/polished may be directly abraded with the separated abrasive particles on the wheel 12 of FIG. 1. Alternately, the upper surface of the wheel 12, with or without a paper disc covering, is deposited with the thus separated abrasive particles in the form of concentric rings. These separated abrasive particles are then bonded to the paper (or cloth) disc by, e.g., the usual glue, vitrified, silicate, shellac, resinoid, rubber, or magnesite bonding methods.

Figure 2:
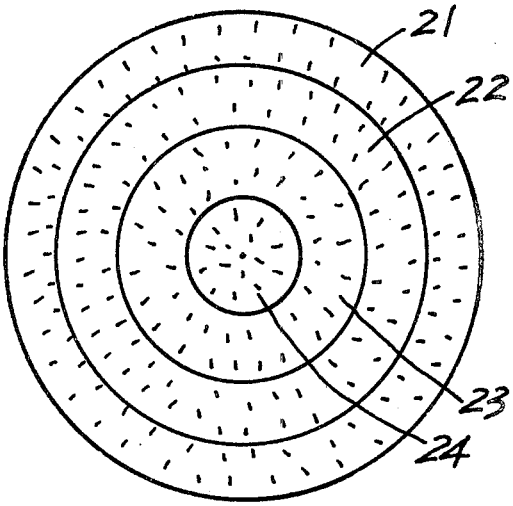
FIG. 2 shows another type of sandpaper or grinding-/polishing wheel.

A third alternative is silk-print presorted or separated abrasive particles, one size for a given concentric ring, such as 21, 22, 23, or 24 in FIG. 2. Overlapping the printed rings will cause the rings to merge somewhat continuously with each other. If there is no overlapping of the silk-printing, the new abrasive wheel or disc will have distinct concentric rings 21–24 of decreasing abrasive particle sizes toward the center of the wheel 12.

Figure 3:
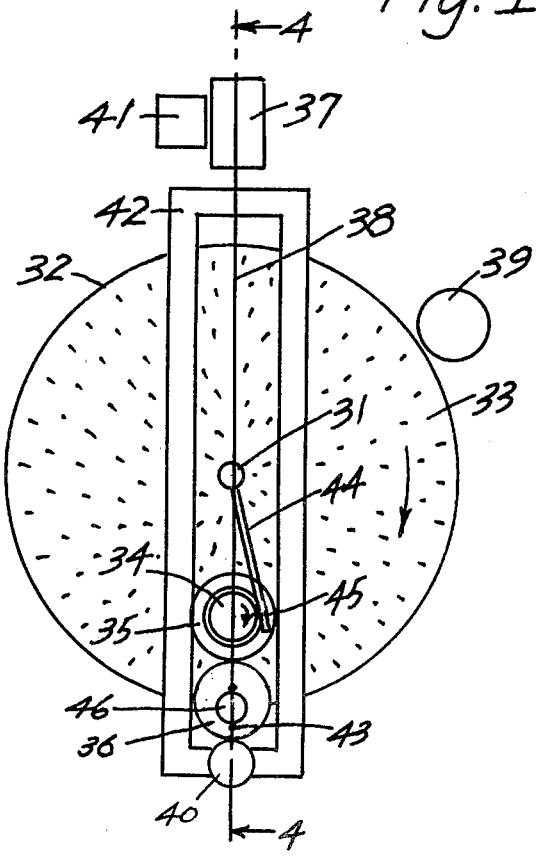
FIG. 3 is a top view of a new grinding/polishing apparatus.
Figure 4:
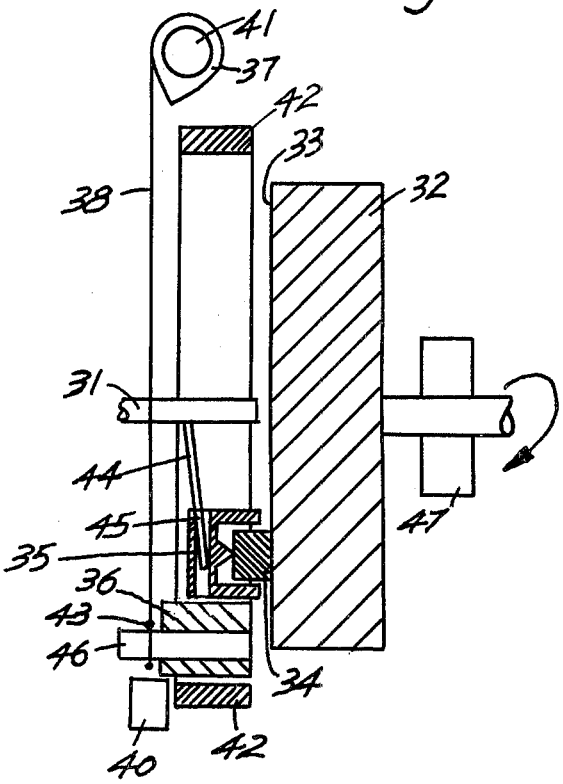
FIG. 4 is a cross-sectional view of the apparatus of FIG. 3, taken along the line 4—4.

FIGS. 3 and 4 show an improved mechanical surface preparation apparatus. The horizontal circular wheel 32 (6 to 50 inches or 15 to 127 cm in diameter) has a flat and planar, smooth or grooveless upper surface 33 with a center, about which the wheel 32 is driven by a motor 39 /or pulley 47, so programmed that the wheel rotates at a slow speed at first but increases in speed as the grinding/polishing operation proceeds. A feed pipe 31 is provided at the center of the wheel to feed the mixed abrasive particles suspended in an air, oil, or water medium. This mixed abrasive particles are centrifugally separated in a manner somewhat as described in connection with FIG. 1. Duct feeding of the abrasive particles, similar to that also described in reference to FIG. 1, can also be used here. Another alternative is to use a wheel or disc having the separated or continuously merging abrasive particles in concentric rings, as described previously.

In any case, the mixed abrasive particles in the proper suspension are impelled by centrifugal force and are therefore centrifugally separated, coarse particles being outmost. Specifically, the mixed abrasive particles are forced to move from linear paths of increasing separation distances therebetween, inside the expanding, curved feed duct 14. The larger and denser abrasive particles, being more affected by centrifugal forces, are thus fed to the horizontal wheel 12 at near the periphery thereof, while the finer and lighter abrasive particles are fed near the center O of the same wheel 12. The separated abrasive particles are discharged onto an elongated discharge region centered along a major or significant portion of a line extending from the center of the wheel to the periphery thereof. Such a line is, in FIG. 1, a radius of the wheel.

The duct 14 is of constant thickness, but has a continuously or monotonically expanding width. In the former case, every (feed particles) downstream width is greater than any previous widths while in the later case every downstream width is greater than or equal to any previous widths. The entrance end 13 is of small width so that the mixed abrasive particles in a suitable suspension form can be fed with a simple, cylindrical pipe or tube. As shown in FIG. 1, the expanding feed duct 14 also is curved in shape, so that the mixed abrasive particles fed thereinto not only move in expanding streams of increasing separation distances therebetween, but also move curvedly and cause the thus-generated centrifugal force to separate the mixed abrasive particles according to their densities and sizes. The result is that the larger and denser particles are near the periphery of the wheel 12 or 32, while the smaller and lighter particles are closer to the center O of the wheel 12 or 32, both before and after exit at the exit end 15 from the feed duct 14.

The material sample 34 is held under the weight of, and rotated by, the holding ring 35. This ring, made of or coated with a low-frction material such as Teflon and making peripheral and a single, pointed central contact with the sample 34, is driven to rotate, continuously or intermittently, by the driving wheel. The driving wheel 36 is actuated by a suitable means such as a speed-programed motor 40. A third motor 41 rotates the cam 37 which winds up the pull string 38 to cause, with the aid of the slip ring 43, the sample 34 to move, at diminishing velocities, toward the center of the wheel 32, as the surface preparation process proceeds.

It can be seen that the material sample 34 is abraded with abrasive particles of decreasing particle sizes as the surface preparation process proceeds. The sample 34 is pressed against the wheel surface 33, preferably with reducing pressure as the preparation process proceeds by, e.g., an inclined (5° to 20°) guide rod 44 whose upper end is welded to the central feed pipe 31 and whose lower end slips in a groove 45 in guide ring 35. The rotational speed of the wheel 32 is also changable (i.e., increased) as the surface preparation process proceeds and as the material sample 34 is moved inward, by suitable programming of the speed of motor 39.

It can be seen that the abrasive particles can only move radially outward by the centrifugal forces resulted from the wheel rotation. This condition, in addition to the central feeding of the mixed abrasive particles and/or the location of the centrifugally separated abrasive particles on the grinding/polishing wheel 32, causes no contamination of the finer abrasive particles by the larger particles. Clean grinding/polishing results thus are assured. The automatically controlled sample pressing, radial movement, wheel speed,..., insure fast, efficient, and reproducible results regardless of the skill of the operator.

By simple modifications including doubling the number of holding ring 35, driving wheel 36, programmed motor 40, ..., the grinding/polishing machine of FIGS. 3 and 4 then allows two samples 34 to be placed in the same rectangular frame 42, but on opposite sides of the feed tube 31. These two samples, in their respective sample holding rings 35 (which are attached to but driven by the driving wheels 36) are simultaneously ground/polished and driven to move by the same string 38, cam 37, and motor 41. This achieves doubled production rates and balanced weights on the wheel 32 thereby minimizing vertical vibrations. Such vibrations often limit the maximum wheel speed that can be employed.

As an example, I make the wheel 32 about 15"(38.1 cm) in diameter. The mixed alumina and/or silicon carbide abrasive particles (4 to 600 mesh) are made into a water (or oil) suspension containing approximately one teaspoonful of the particles per liter of suspension. The suspension is fed at about 200–500 cc/minute through the central feed pipe 31 or into a ¼" high feed duct 14 having a ¼" entrance pipe 13 but expands at the exit end 15 to 12"(30.5 cm) wide radially centered along a wheel radius. Since the rate of abrasion depends on the linear velocity rather than the wheel rpm, I keep the linear velocity below about 10,000 cm/sec. To grind/polish GaAs (gallium arsenide) wafers 1"diam ×0.010"(2.54 cm diam ×0.254 mm), the speed of the wheel 32 is programmed via motor 39 to start at 300 rpm but finish at 500 rpm. The pressure on the wafers decreases from 300 g(on each wafer) in the beginning to 150 g toward the end of the operation. For the 12"(30.5 cm) radially inward sample movement, the initial velocity is 4 cm/min but the finishing velocity is only 2 cm/min. It takes 10.2 minutes to finish the grinding/polishing operation. The sample, therefore, decelerates at a constant deceleration of about 0.2 $cm^2$/min.

The invention is not to be construed as limited to the particular forms disclosed herein, since these are to be regarded as illustrative rather than restrictive.

I claim:

1. An apparatus for grinding/polishing a material sample surface comprising:

a horizontal circular wheel having a planar and smooth, upper surface containing a center and rotatable about a central vertical axis of rotation which passes through the center; and means for simultaneously feeding, from an entrance end, mixed abrasive particles for discharge at an exit end onto an elongated discharge region on the upper surface, said discharge region extending over a major portion of a selected line which extends from the center to the periphery of the wheel, said mixed abrasive particles being suspended and carried by a fluid, the motion of the carrying fluid flowing in the feeding means producing centrifugal forces which simultaneously act on all the mixed abrasive particles to cause the mixed abrasive particles to separate according to their densities and sizes before their discharge onto the discharge region on the upper surface.

2. The apparatus as in claim 1 wherein the feeding means comprises a curved feed duct, the flow of the fluid, with its suspended mixed abrasive particles, in passing through the curved duct producing centrifugal forces on the mixed particles to cause them to separate into streams of separated abrasive particles continuously merging with streams of lighter and finer abrasive particles toward the center of the wheel.

3. The apparatus as in claim 2 wherein the feed duct is of substantially constant thickness but of continuously expanding width from the entrance end toward the exit end thereof and also in a plane parallel to the upper surface so that the mixed abrasive particles attain sufficient moving velocities and centrifugal forces inside the duct to achieve the desired centrifugal separation therein while discharging from the duct at a velocity lower than any other velocities prior to the exit or discharge therefrom.

4. The apparatus as in claim 2 wherein the mixed abrasive particles are of substantially constant density and are thus centrifugally separated according to their sizes, large particles being discharged at near the periphery of the wheel while finer particles being discharged closer to the center of the wheel.

5. The apparatus as in claim 4 including means for driving the wheel and programmed to rotate the wheel at a slow speed at first but to increase the speed as the surface preparation process proceeds and as the material sample is moved from near the periphery of the wheel where the separated abrasive particles are of relatively large sizes toward the center of the wheel where the separated abrasive particles are of relatively finer sizes.

6. The apparatus as in claim 1 wherein the elongated discharge region extends along a radius of the wheel and the mixed abrasive particles are separated into streams which are directed generally normally of the radius and in the tangential directions of the wheel.

7. The apparatus as in claim 6 wherein the separated streams are generally tangentially oriented streams of separated abrasive particles which are oriented in the same direction as the direction of rotation of the wheel.

8. The apparatus as claimed in claim 1 including:

means for holding the sample;

means for positioning the sample initially at an outer position on the upper surface of the wheel;

means for applying pressure onto the material sample against the upper surface; and means for moving the sample generally in the radially inward direction so that the sample is mechanically surface prepared with progressively finer abrasive particles in a single operation.

9. The apparatus as in claim 8 including means for decreasing the pressure applied onto the sample as the sample is moved in the radially inward direction.

10. The apparatus as in claim 8 including means for decreasing the velocity of said radially inward movement as the surface preparation process proceeds.

11. The apparatus as in claim 8 including means for rotating the sample about a vertical axis contained therein as the sample preparation process proceeds.

12. A device for feeding mixed abrasive particles onto a grinding/polishing apparatus for preparing a material sample surface with mixed abrasive particles suspended in and carried by a fluid, said apparatus being of the type having a horizontal circular wheel having a upper surface for receiving the abrasive particles and containing a center and rotatable about a central vertical axis of rotation which passes through the center, comprising: a curved feed duct having an entrance end and an exit end and having also an expanding width in the direction of the plane of the wheel from the entrance end to the exit end, the flow of the fluid carrying the mixed abrasive particles in suspension generating centrifugal forces which centrifugally separate inside the duct the mixed abrasive particles according to their sizes and densities, the exit end of the duct extending over at least a major portion of a selected line which extends from the center of the wheel toward the periphery thereof so that larger and heavier abrasive particles, being more affected by the centrifugal forces, are discharged onto the wheel at near the periphery thereof while the finer and lighter abrasive particles are discharged near the center of the wheel.

* * * * *